United States Patent [19]

Kristensen et al.

[11] 4,328,753

[45] May 11, 1982

[54] LOW-ENERGY FUSE CONSISTING OF A PLASTIC TUBE THE INNER SURFACE OF WHICH IS COATED WITH EXPLOSIVE IN POWDER FORM

[75] Inventors: Leif Kristensen; Hans Lundborg; Stig Nyqvist, all of Nora, Sweden

[73] Assignee: Nitro Nobel AB, Gyttorp, Sweden

[21] Appl. No.: 63,750

[22] Filed: Dec. 21, 1979

[51] Int. Cl.[3] ..... C06C 5/04

[52] U.S. Cl. ..... 102/275.5; 102/275.8

[58] Field of Search ..... 102/275.5, 275.8

[56] References Cited

U.S. PATENT DOCUMENTS

| | | | |
|---|---|---|---|
| 3,027,839 | 4/1962 | Grandy et al. | 102/275.5 |
| 3,428,502 | 1/1969 | Evans | 102/275.8 X |
| 3,431,849 | 3/1969 | Kern et al. | 102/331 X |
| 3,590,739 | 7/1971 | Persson | 102/275.5 |
| 3,968,724 | 7/1976 | Kowalick | 102/324 X |
| 4,060,033 | 11/1977 | Postupak | 102/318 |

FOREIGN PATENT DOCUMENTS

| | | |
|---|---|---|
| 1328387 | 8/1973 | United Kingdom . |

*Primary Examiner*—Peter A. Nelson

*Attorney, Agent, or Firm*—Hane, Roberts, Spiecens & Cohen

[57] ABSTRACT

Low-energy fuse in the form of a plastic tube the inner surface of which is coated with explosive. In order to prevent the explosive from being dislodged, the plastic tube is of sandwich-type, the outer part of which will withstand mechanical stress and the inner part of which has such adhesion to the explosive agent that this is only dislodged by a shock wave.

4 Claims, 1 Drawing Figure

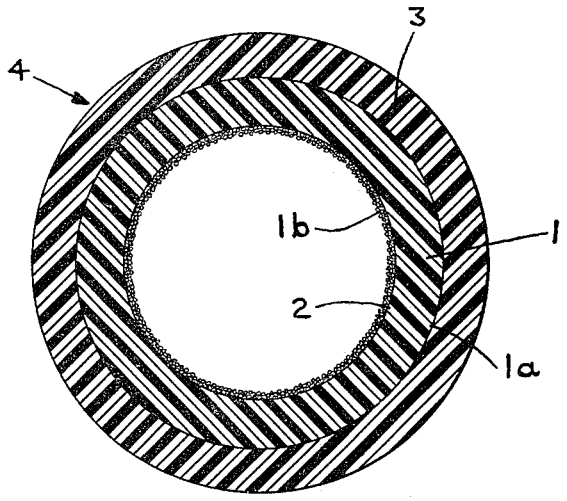
3
4
1b
1
2
1a

LOW-ENERGY FUSE CONSISTING OF A PLASTIC TUBE THE INNER SURFACE OF WHICH IS COATED WITH EXPLOSIVE IN POWDER FORM

FIELD OF THE INVENTION

Prior Art

The present invention relates to a low-energy fuse. A known type of such a fuse consists of a plastic pipe or tube normally having an outer diameter of about 3 mm and an inner diameter of about 1.3 mm. A suitable material for the plastic tube may be Surlyn 1554 marketed by DuPont. Such a plastic tube or pipe is coated on the inside with an explosive agent. This may consist of a mixture of cyclotetramethylene tetranitramine and aluminium powder. The ratio of the mixture may be about 91% of the first substance and about 9% of the second substance. If such a fuse is ignited at one end, a shock wave or detonation is obtained due to the coating of explosive, this wave travelling from the starting end to the other end of the fuse. A detonator is generally arranged at the other end of the fuse.

It has been found that explosive in powder form which is applied to the inner surface of the plastic tube does not adhere sufficiently firmly to this surface, the explosive powder often becoming dislodged from the inner surface during transport or storage. During handling, the powder may form blockages in the tube or fall down into said detonator. If a shock wave encounters such a blockage it will terminate at this point. If the explosive powder falls down into the detonate, this may be destroyed without effecting the desired ignition of the explosive substance it is intended to cause to explode.

SUMMARY OF THE INVENTION

An object of the present invention is to prevent there being a sufficient quantity of loose explosive powder inside the plastic tube to enable plugs of explosive agent to be formed. According to the invention this object can be achieved by using a plastic tube of sandwich-type i.e. a composite consisting of two parts, an outer part and an inner part. The outer part endows the plastic tube with resistance to external damage and the inner part is provided with an inner surface with such adhesion that explosive agent applied thereon is dislodged substantially only by a shock wave.

The material in the outer part of the plastic tube is selected from polyamide, polypropene, polybutene and similar polymer having satisfactory mechanical properties. Due to the outer part the plastic tube acquires a tensile strength of not less than 35 MPa.

The material in the inner part of the plastic tube is selected from plastic materials suitable for adhesive film, this material giving the inner surface of the inner part such adhesive ability with respect to the explosive that this will only be dislodged from the surface by a shock wave. The plastic selected should preferably have an attractive force of about 5.5 g/m$^2$.

The plastic tube in accordance with the present invention can be manufactured by first extruding the inner part and then passing said inner part through a coating extruder where the outer part is sprayed on. A coating bath or painting on by brush is also feasible. Of course, both the outer part and the inner part can be produced simultaneously by means of extrusion through a specially designed nozzle.

With a plastic tube having an outer diameter of ca. 3 mm and an inner diameter of ca. 1.3 mm there should be at least 2.7 g explosive per m$^2$ on the inner surface of the tube. Such a quantity of explosive will ensure that the shock wave is transmitted in the desired manner. Said quantity of explosive can easily be retained on the inner surface of a plastic tube in accordance with the present invention.

BRIEF DESCRIPTION OF THE DRAWING

The sole FIGURE of the drawing is a transverse cross-section through a low energy fuse according to the invention.

A plastic tube 1 is extruded in which the plastic material constitutes Surlyn 1855 of such a type that the plastic tube produced has an adhesive outer sheath surface 1*a* and an adhesive inner sheath surface 1*b*. The adhesive surface 1*b* provides excellent adhesion for an explosive agent 2 consisting of a powder mixture of cyclotetramethylene tetranitramine and aluminium powder.

The essential feature of the tube obtained is that its inner sheath surface retains the explosive powder so that it does not become dislodged and form plugs or remains as loose powder inside the tube during transport or storage. After production, the tube 1 is coated internally with the desired quantity of explosive powder 2. According to the above, the quantity shall be such that there is at least 2.7 g of powder per m$^2$ of the inner surface. The tube produced has an inner diameter of 1.3 mm and an outer diameter of 3 mm. The tube with adhesive sheath surfaces is passed through a coating extruder to form an outer layer 3. The coating is given a thickness of about 0.3 mm and the material of the coating is such that the finished tube 4 has a tensile strength of not less than 35 MPa. A suitable material for the outer layer 3 is polyamide, but other materials such as polypropene or polybutene may also be used.

Thanks to the outer layer 3, the formed tube 4 can withstand mechanical stress to a considerable extent, and the mechanical stresses can be quite considerable on a working site. Thanks to the adhesive inner surface 16 of the tube 1, it is guaranteed that the explosive powder applied will remain on the inner surface of the tube 1.

Experiments have been performed with tubes on which 7 g of explosive powder has been applied per m$^2$ of the inner surface in order to determine the adhesive ability. Internally coated tubes were used for these experiments, which were clamped at two points $\frac{1}{3}$ m apart. The clamped tubes were then subjected to the action of a clapper hammering on the clamped tube with a frequency of 40 Hz and an amplitude of 2.5 mm for 60 seconds.

The following indicates how much of the powder which was applied became dislodged with various tube materials. The quantity is stated as a percentage.

| Tube material | % dislodged powder |
|---|---|
| Surlyn 1554 | 47% |
| Surlyn 1706 | 61% |
| Surlyn 1707 | 57% |
| Surlyn 1855 | 3% |

The use of an inner tube 1 with an adhesive sheath surface enables the inner surface to be coated with explosive powder in a quantity of up to about 7 g/m$^2$. Tubes used previously have enabled a coating of up to about 4 g/m$^2$. The good adhesive ability of plastic tube in accordance with the present invention enables it to be stored over a long period and to be subjected to rough treatment while the plastic tube is being fitted, without the explosive powder being dislodged from the sheath surface.

We claim:

1. A low-energy fuse comprising a plastic tube having an inner surface and a coating of explosive in powder form on said inner surface, said plastic tube being of sandwich-type and comprising an outer part having relatively high resistance to external damage and an inner part having an inner adhesive surface on which said explosive is adherently applied, said inner surface having relatively high adhesion so that said explosive applied thereto is dislodged substantially only by a shock wave, said inner part having an outer surface and said outer part having an inner surface directly engaged with said outer surface of said inner part.

2. A low-energy fuse according to claim 1, wherein said outer part consists of polyamide, polypropene or polybutene providing the plastic tube with a tensile strength of at least 35 MPa.

3. A low-energy fuse according to claim 1, wherein said inner part consists of a material suitable for making adhesive film and with an adhesive property of at least 5.5 g/m$^2$ with a particle size of the explosive agent of 10–30 $\mu$m.

4. A low energy fuse as claimed in claim 1 wherein said outer surface of said inner part is adhesive and said outer part is adhesively secured directly to said inner part.

* * * * *

UNITED STATES PATENT AND TRADEMARK OFFICE

CERTIFICATE OF CORRECTION

PATENT NO. : 4,328,753

DATED : May 11, 1982

INVENTOR(S) : Leif Kristensen; Hans Lundborg; Stig Nyqvist

It is certified that error appears in the above-identified patent and that said Letters Patent are hereby corrected as shown below:

On the title page, Insert:

-- Foreign Application Priority Data

August 8, 1978 (SE) Sweden.....7808463 --.

Signed and Sealed this

Ninth Day of November 1982

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,328,753

DATED : May 11, 1982

INVENTOR(S) : Leif Kristensen, et al.

It is certified that error appears in the above-identified patent and that said Letters Patent is hereby corrected as shown below:

On the title page, item [22], change the filing date to August 6, 1979.

Signed and Sealed this

Nineteenth Day of January, 1993

*Attest:*

DOUGLAS B. COMER

*Attesting Officer*

*Acting Commissioner of Patents and Trademarks*